US010262770B2

(12) United States Patent
Varkey et al.

(10) Patent No.: US 10,262,770 B2
(45) Date of Patent: Apr. 16, 2019

(54) METHOD OF MAKING A CABLE

(71) Applicant: Schlumberger Technology Corporation, Sugar Land, TX (US)

(72) Inventors: Joseph Varkey, Sugar Land, TX (US); Burcu Unal Altintas, Richmond, TX (US); Dong Yang, Sugar Land, TX (US); Sheng Chang, Sugar Land, TX (US); Qingdi Huang, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 15/618,657

(22) Filed: Jun. 9, 2017

(65) Prior Publication Data

US 2017/0278592 A1 Sep. 28, 2017

Related U.S. Application Data

(63) Continuation of application No. 14/546,644, filed on Nov. 18, 2014, now Pat. No. 9,679,677.

(60) Provisional application No. 61/906,301, filed on Nov. 19, 2013.

(51) Int. Cl.

| | |
|---|---|
| ***H01B 7/18*** | (2006.01) |
| ***H01B 7/04*** | (2006.01) |
| ***H01B 7/14*** | (2006.01) |
| ***H01R 43/28*** | (2006.01) |

(52) U.S. Cl.

CPC ..... *H01B 7/18* (2013.01); *H01B 7/046* (2013.01); *H01B 7/14* (2013.01); *H01R 43/28* (2013.01); *Y10T 29/49194* (2015.01)

(58) Field of Classification Search

CPC ..... H01B 7/00; H01B 7/0208; H01B 7/0216; H01B 9/02; H01B 13/00; H01B 7/046; H01B 7/14; H01B 7/18; H01R 43/28; Y10T 29/49194

See application file for complete search history.

(56) References Cited

U.S. PATENT DOCUMENTS

| | | | | |
|---|---|---|---|---|
| 6,583,360 | B1 | 6/2003 | Yudashkin | |
| 7,188,406 | B2 | 3/2007 | Varkey et al. | |
| 7,288,721 | B2 * | 10/2007 | Varkey | H01B 7/0291 174/102 R |
| 7,793,409 | B2 | 9/2010 | Varkey | |
| 2007/0107928 | A1 | 5/2007 | Varkey et al. | |
| 2009/0089998 | A1 | 4/2009 | Varkey | |
| 2009/0242194 | A1 | 10/2009 | Varkey et al. | |
| 2015/0037581 | A1 | 2/2015 | Varkey et al. | |

FOREIGN PATENT DOCUMENTS

| | | |
|---|---|---|
| WO | WO2011106513 A2 | 9/2011 |

OTHER PUBLICATIONS

Extended Search Report issued in the related EP Application 14193742.5, dated Mar. 9, 2015, (6 pages).

EP Communication issued in the related EP Application 14193742.5, dated Nov. 26, 2015, (4 pages).

* cited by examiner

*Primary Examiner* — Carl Arbes

(74) *Attorney, Agent, or Firm* — Eileen Pape

(57) ABSTRACT

A cable that has a cable core with a first armor wire layer and a second armor wire layer. The second armor wire layer is segregated from the first armor wire layer, and an outer jacket is disposed about the second armor wire layer.

4 Claims, 7 Drawing Sheets

METHOD OF MAKING A CABLE

CROSS-REFERENCE TO RELATED APPLICATIONS

This application is a continuation of co-pending U.S. patent application Ser. No. 14/546,644, filed Nov. 18, 2014, to Joseph Varkey et al, and which claims priority from Provisional Application Ser. No. 61/906,301, filed Nov. 19, 2013, the aforementioned patent applications are herein incorporated by reference.

FIELD OF THE DISCLOSURE

The disclosure generally relates to a cable and method of making a cable.

BACKGROUND

During well operations cable is used to convey equipment into a wellbore. Often the cable transmits power downhole to downhole equipment and provides communication between downhole equipment and the surface. The cables are often sealed off in packoffs at a wellhead against downhole pressure.

The sealing capabilities of the cable, however, are reduced if the armor wire cables are not properly segregated from one another. For example, if the armor wire cables are allowed to be in contact a pathway can easily form that allows pressurized gas to travel up the cable.

SUMMARY

An embodiment of a cable includes a cable core. A first armor wire layer and a second armor wire layer are located about the cable core, and the second armor wire layer is segregated from the first armor wire layer. An outer jacket is located about the second armor wire layer.

An embodiment of method of making a cable includes placing a first armor wire layer about a cable core and a first insulating layer. The method also includes placing a second insulating layer about the first armor wire layer. The method also includes placing a second armor wire layer about the second insulating layer, thereby, separating the first armor wire layer from the second armor wire layer. The method also includes placing an outer jacket about the second armor wire layer.

Another embodiment of making a cable includes placing two armor wire layers about a cable core, and separating the armor wire layers from one another. The method also includes placing an outer jacket about the one of the armor wire layers.

DETAILED DESCRIPTION OF THE INVENTION

Figure 1A:
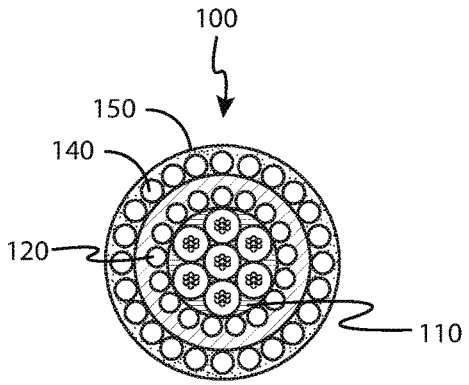
FIG. 1A depicts an embodiment of a cable.

Certain examples are shown in the above-identified figures and described in detail below. In describing these examples, like or identical reference numbers are used to identify common or similar elements. The figures are not necessarily to scale and certain features and certain views of the figures may be shown exaggerated in scale or in schematic for clarity and/or conciseness.

An example cable includes a cable core. The cable core can be any now known or future known cable core. A first armor wire layer and a second armor wire layer can be disposed about the cable core. The first armor wire layer and the second armor wire layer can have any number of armor wire strands. The armor wire can be made from any material. Illustrative materials include metallic wires, fiber reinforced nylon wires, or other structurally sufficient wires.

An outer jacket is located about the second armor wire layer. The outer jacket can be any material. Illustrative materials include polymer, carbon-fiber-reinforced polymer, and low-melt-temperature polymer.

A first insulating layer can be located between the cable core and the first armor wire layer. The first armor wire layer can be embedded into the first insulating layer. The first insulating layer can be any material. Illustrative materials include polymers, low-melt-temperature polymers, carbon-fiber-reinforced polymers or the like.

A second insulating layer can be located between the first armor wire layer and the second armor wire layer, and the first insulting layer can be bonded with the second insulating layer. The second insulting layer can be any material and construction. For example, the second insulating layer can be a low-melt-temperature polymer disposed about a high-melt-temperature polymer; a polymer with a plurality of ridges; a carbon-fiber-reinforced polymer; a bondable tape embedded in a polymer; a cross-linked polymer bonded with another polymer; a cabled yarn embedded in a polymer; or the like.

An example method of making a cable can include placing a first armor wire layer about a cable core and a first insulating layer. The method can include heating the first insulating layer prior to placing the first armor wire layer about the first insulating layer, allowing the first armor wire layer to embed into the first insulating layer. The first insulating layer can be heated using any heating source. Illustrative heating sources include an infrared heat source, a hot air heat source, an electric heat source or the like.

The method can also include placing a second insulating layer about the first armor wire layer. The second insulating layer acts like a barrier between the first armor wire layer and the second armor wire layer. Accordingly, the first armor wire layer and the second armor wire layer are segregated from one another.

In an embodiment the method can include embedding the second armor wire layer into the second insulating layer by heating an outer portion of the second insulating layer, such as low-melt-temperature polymer, disposed about an inner portion of the second insulating layer, such as a high-melt-temperature polymer. For example, the outer portion can be heated using a heat source, softening the outer portion, and the second armor wire layer can at least partially embed into the softened outer portion. The inner portion is not softened by the heat applied to the outer portion and the inner portion remains hard. As such, the second armor wire layer is prevented from passing through the inner portion of the second insulating layer.

The method can also include placing an outer jacket about the second armor wire layer. The outer jacket can be a polymer or other suitable material. The outer jacket can have a smooth profile.

Figure 1B:
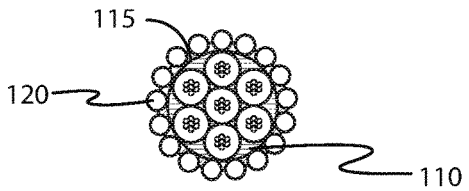
FIG. 1B depicts a cable core, first insulating layer, and first armor wire layer of the cable of FIG. 1A.
Figure 1C:
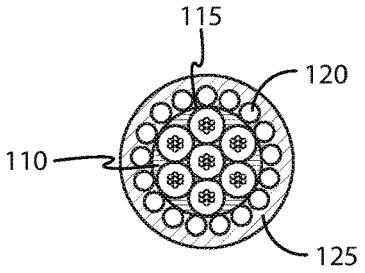
FIG. 1C depicts an inner portion of a second insulting layer disposed about the first armor wire layer of FIG. 1B.
Figure 1D:
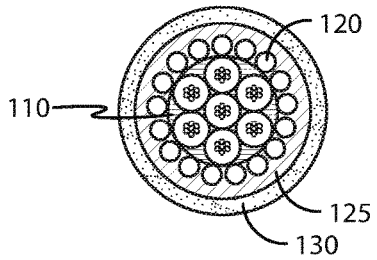
FIG. 1D depicts an outer portion of the second insulating layer disposed about the inner portion of FIG. 1C.
Figure 1E:
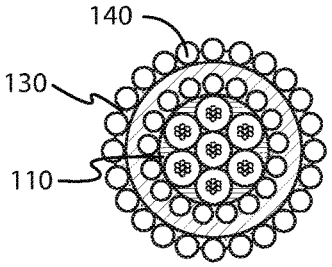
FIG. 1E depicts a second armor wire layer disposed about the second insulating layer of FIG. 1D.

Turning now to the FIGS., FIG. 1A depicts an embodiment of a cable. FIG. 1B depicts a cable core, the first insulating layer, and the first armor wire layer of the cable of FIG. 1A. FIG. 1C depicts an inner portion of a second insulting layer disposed about the first armor wire layer of FIG. 1B. FIG. 1D depicts an outer portion of the second insulating layer disposed about the inner portion of the second insulating layer of FIG. 1C. FIG. 1E depicts a second armor wire layer disposed about second insulating layer of FIG. 1D.

Referring to FIGS. 1A to 1D, a cable 100 includes a cable core 110, a first armor wire layer 120, a second armor wire layer 140, and an outer jacket 150.

The cable core 110 has a first insulating layer 115 disposed thereabout, and the first armor wire layer 120 is at least partially embedded into the first insulating layer 115. The first insulating layer 115 can fill interstitial spaces in the first armor wire layer 120.

A second insulating layer that includes an inner portion 125 and an outer portion 130 can be disposed about the first armor wire layer 120. The inner portion 125 can be between the first armor wire layer 120 and the outer portion 130. The inner portion 125 can bond with the first insulating layer 115.

The second armor wire layer 140 is at least partially embedded into the outer portion 130; the outer jacket 150 is disposed about the second armor wire layer 140, and the outer jacket 150 is bonded with the outer portion 130.

The cable 100 can be made by placing the first insulating layer 115 about the cable core 110. The first insulating layer 115 can be heated prior to the first armor wire layer 120 being placed thereabout. The first armor wire layer 120 can be cabled helically about the heated first insulating layer 115, and the first armor wire layer 120 can at least partially embed into the first insulating layer 115.

The second insulating layer can then be disposed about the first armor wire layer 120. The second insulating layer includes the inner portion 125 and the outer portion 130. Accordingly, the inner portion 125 can be disposed about the first armor wire layer 120, and the outer portion 130 can be disposed about the inner portion 125. The inner portion 125 and the outer portion 130 can be bonded with one another using a compatible layer placed between them.

After the second layer is formed, the outer portion 130 can be heated, and the second armor wire layer 140 can be disposed about the heated outer portion 130. The second armor wire layer 140 can be at least partially embedded into the outer portion 130, the outer jacket 150 can be placed about the second armor wire layer 140 and the outer jacket 150 can bond with the outer portion 130.

Figure 2A:
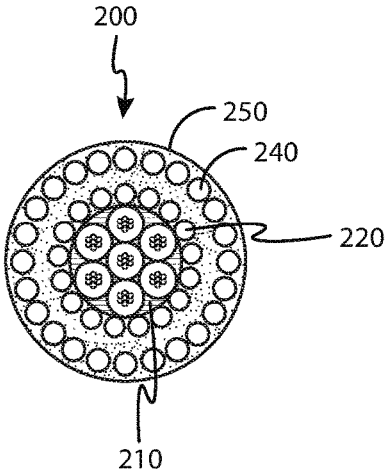
FIG. 2A depicts another example cable.
Figure 2B:
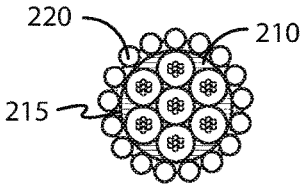
FIG. 2B depicts the cable core of the cable of FIG. 2A with a first armor wire layer located thereabout.
Figure 2C:
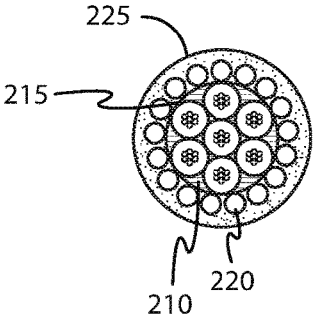
FIG. 2C depicts a first portion of a second layer disposed about the first armor wire layer.
Figure 2D:
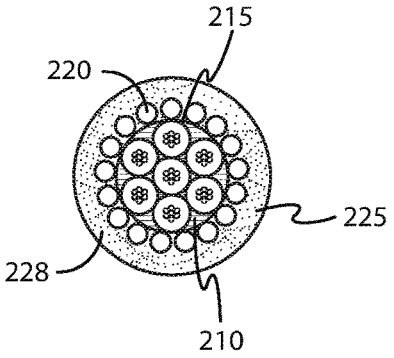
FIG. 2D depicts a second portion of the second layer disposed about the first portion.

FIG. 2A depicts another example cable. FIG. 2B depicts the cable core of the cable of FIG. 2A with a first armor wire layer located thereabout. FIG. 2C depicts a first portion of a second layer disposed about the first armor wire layer. FIG. 2D depicts a second portion of the second layer disposed about the first portion.

Referring to FIGS. 2A to 2D, the cable 200 includes a cable core 210, a first armor wire layer 220, a second armor wire layer 240, and an outer jacket 250.

The first armor wire layer 220 is at least partially embedded in a first insulating layer 215 located about the core. The first armor wire layer 220 has an inner portion 225 of a second insulating layer located thereabout. The inner portion 225 can bond with the first insulating layer 215. The inner portion 225 can be made from virgin polymer or other suitable materials.

An outer portion 228 is disposed about the inner portion 225 to form the second insulation layer. The outer portion 228 can be a carbon-fiber-reinforced polymer, a glass-fiber reinforced polymer or the like. The second armor wire layer 240 can be at least partially embedded into the outer portion 228, and the outer jacket 250 can be located about the outer portion 228. The outer jacket 250 can bond with the outer portion 228.

The cable 200 can be made by placing the first insulating layer about the cable core 210. The first insulating layer 215 can be softened by heating the first insulating layer prior to placing the first armor wire layer 220 on the first insulating layer 215. The first armor wire layer 220 can be cabled helically about the first insulating layer 215, and the first armor wire layer 220 can at least partially embed into the first insulating layer 215.

Then the inner portion 225, which can be a thick layer of virgin polymer, can be placed about the first armor wire layer 220. The outer portion 228 can be placed about the inner portion 225. The outer portion 228 can be a carbon reinforced polymer that is compatible with inner portion 225 and the outer portion 228 and inner portion 225 can form the second insulating layer.

The outer portion 228 can be heated so that the second armor wire layer 240 can at least partial embed into the outer portion 228 when the second armor wire layer is placed about the outer portion 228. The second armor wire layer 240 can be placed about the outer portion 228 by counter-helically cabling the second armor wire layer about the outer portion 228.

The outer jacket 250, which can be a carbon-fiber reinforced polymer, can be placed over the second armor wire layer 240, and the outer jacket 250 and outer portion 228 can bond with one another through the interstitial spaces in the outer armor wire layer 240.

Figure 3A:
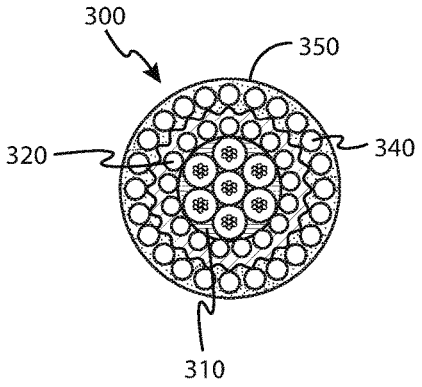
FIG. 3A depicts yet another embodiment of a cable.
Figure 3B:
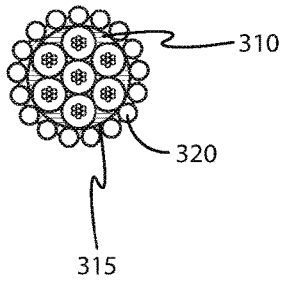
FIG. 3B depicts a cable core of the cable of FIG. 3A with a first armor wire layer located thereabout.
Figure 3C:
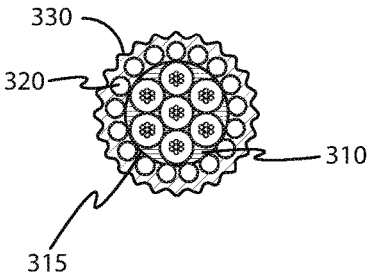
FIG. 3C depicts a second insulating layer disposed about the first armor wire layer.
Figure 3D:
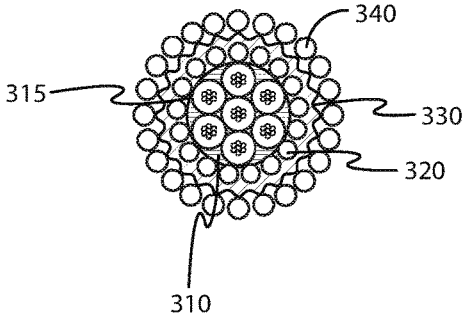
FIG. 3D depicts a second armor wire layer located about the second insulating layer.

FIG. 3A depicts yet another embodiment of a cable. FIG. 3B depicts a cable core of the cable of FIG. 3A with a first armor wire layer located thereabout. FIG. 3C depicts a second insulating layer disposed about the first armor wire layer. FIG. 3D depicts a second armor wire layer located about the second insulating layer.

Referring to FIGS. 3A to 3D, the cable 300 includes a cable core 310, a first armor wire layer 320, a second armor wire 340, and an outer jacket 350.

The first armor wire layer 320 can be at least partially embedded in a first insulating layer 315. A second insulating layer 330 can be located about the first armor wire layer 320, and a plurality of ridges can be formed on the outer perimeter of the second insulating layer 330. The second insulating layer 330 can bond with the first insulating layer 315.

A second armor wire layer 340 can be located about the second insulating layer 330, and the outer jacket 350 can be located about the second armor wire layer 340. The outer jacket 350 can bond with the second insulating layer 340. The second armor wire layer 340 rests on the peeks of the ridges of the second insulating layer 330.

The cable 300 can be made by placing the first insulating layer 315, which can be a carbon-fiber reinforced polymer, about the cable core 310. The first insulating layer 315 can be heated so that it becomes soft; the first armor wire layer 320 can be placed about the first insulating layer 315, and the first armor wire layer 320 can be at least partially embedded into the first insulating layer 315.

The second insulating layer 330 can be placed about the first armor wire layer 315, and the second insulating layer 330 can be shaped to have a ridged profile. For example, as the second insulating layer is placed on the first armor wire layer 315, the second insulating layer can pass through a shaping die that creates the ridged profile. The ridges can be applied straight, at no lay angle or may be applied helically in the same orientation as the inner armor wire layer 320.

The second armor wire layer 340 can be placed about the second insulating layer 330. For example, the second armor wire layer 340 can be cabled counter-helically about the second insulating layer 330. The second armor wire layer 340 can rest on the peeks of the ridges on the second insulating layer 330, providing greater distance between the first armor wire layer and the second armor wire layer.

The outer jacket 350 can be placed about the second armor wire layer, and the outer jacket 350 can fill valleys between the ridges on the second insulating layer. The outer jacket 350 can be shaped to a circular outer profile.

Figure 4A:
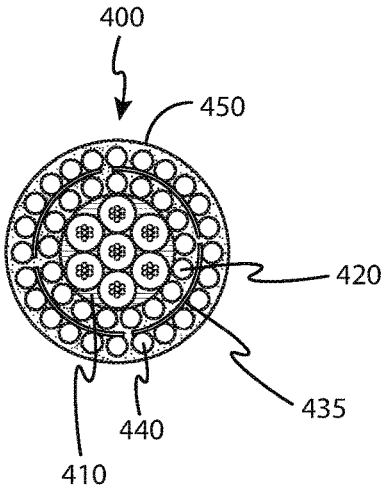
FIG. 4A depicts an additional embodiment of a cable.
Figure 4B:
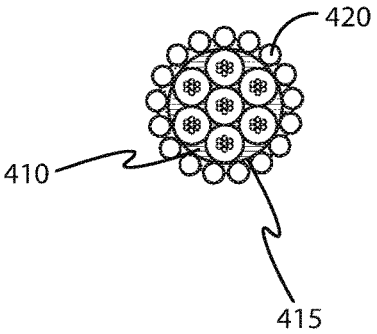
FIG. 4B depicts a cable core of the cable of FIG. 4A with a first armor layer located thereabout.
Figure 4C:
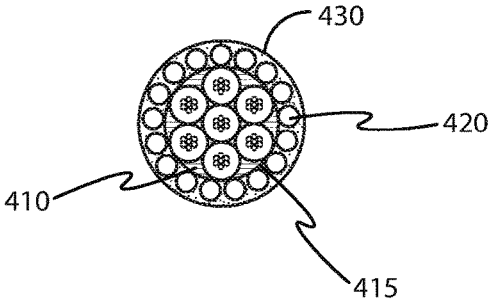
FIG. 4C depicts an inner portion of a second insulating layer disposed about the first armor layer of FIG. 4B.
Figure 4D:
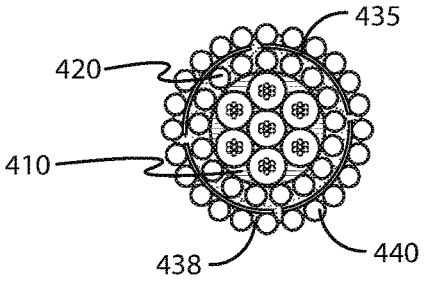
FIG. 4D depicts a second armor wire layer located about a second portion of the second insulating layer that is located about the first portion of FIG. 4C.

FIG. 4A depicts an additional embodiment of a cable. FIG. 4B depicts a cable core of the cable of FIG. 4A with a first armor layer located thereabout. FIG. 4C depicts an inner portion of a second insulating layer disposed about the first armor layer of FIG. 4B. FIG. 4D depicts a second armor wire layer located about a second portion of the second insulating layer that is located about the first portion of FIG. 4C.

Referring to FIGS. 4A to 4D, the cable 400 includes a cable core 410, a first armor wire layer 420, a second armor wire layer 440, a barrier 435, and an outer jacket 450.

The cable core 410 can have a first insulating layer 415 located thereabout. The first armor wire layer 420 can be located about the first insulating layer 415.

A second insulting layer 430 can be located about the first armor wire layer 420. The second insulating layer 430 has a barrier 435. The second insulating layer 430 can bond with the first insulating layer 415.

The barrier 435, which can be a tape, is integrated into the second insulating layer 430. The barrier 435 can be a bondable, polymeric tape.

The second armor layer 440 can be located about the second insulating layer 430; the outer jacket 450 can be located about the second armor layer 440, and the outer jacket 450 can bond with the second insulating layer 430.

The cable 400 can be made by placing the first insulating layer 415 about the cable core 410. The first insulating layer 415 can be heated until it becomes soft, and the first armor wire layer 420 can be placed about the soft first insulating layer 415; thereby, allowing the first armor wire layer 420 to at least partially embed into the first insulating layer 415.

The second insulating layer 430 can be placed about the first armor wire layer 420 by first extruding a polymeric material over the first armor wire layer, wrapping the barrier 435 about the polymeric material, and extruding additional polymeric material about the barrier 435. The barrier 435 can be wrapped about the polymeric material such that it does not overlap.

The second insulating layer 430 can be heated to make the outer polymeric material soft; the second armor wire layer 440 can be placed about the second insulating layer 430, and the second armor wire layer 440 can be at least partially embedded into the second insulating layer 430; however, the depth of embedment is controlled by the location of the barrier 435. The second armor wire layer 440 can be placed about the second insulating layer 430 by cabling the second armor wire layer 440 counter-helically about the second insulating layer 430.

The outer jacket 450 can be placed about the second armor wire layer 440, and the outer jacket 450 can bond with the second insulating layer 430. The outer jacket 450 can be shaped to have a circular outer profile.

Figure 5A:
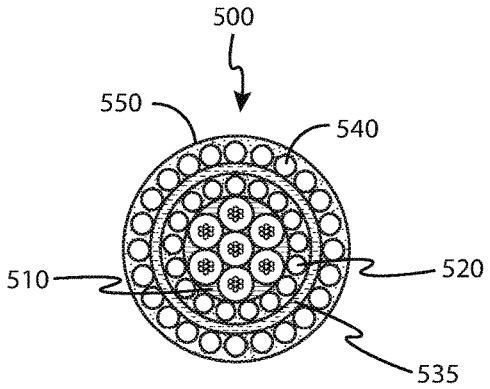
FIG. 5A depicts another embodiment of a cable.
Figure 5B:
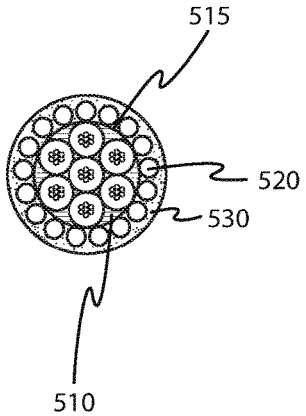
FIG. 5B depicts a cable core of the cable of FIG. 5A with a first armor wire layer located thereabout.
Figure 5C:
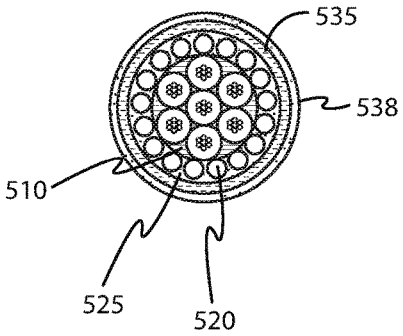
FIG. 5C depicts the first armor wire layer of FIG. 5B with a second insulating layer located thereabout.
Figure 5D:
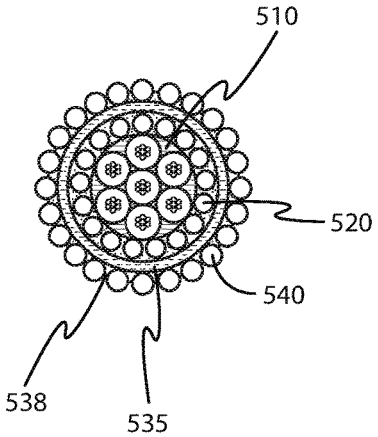
FIG. 5D depicts a second armor wire layer located about the second insulating layer of FIG. 5C.

FIG. 5A depicts another embodiment of a cable. FIG. 5B depicts a cable core of the cable of FIG. 5A with a first armor wire layer located thereabout. FIG. 5C depicts the first armor wire layer of FIG. 5B with a second insulating layer located thereabout. FIG. 5D depicts a second armor wire layer located about the second insulating layer of FIG. 5C.

Referring to FIGS. 5A to 5D, the cable 500 has a cable core 510, a first armor layer 520, a second armor layer 540, a barrier 535, and an outer jacket 550.

The cable core 510 has a first insulating layer 515 located thereabout. The first armor wire layer 520 is located about the first insulating layer 515.

A second insulating layer 530 is located about the first armor wire layer 520. The second insulating layer 530 has the barrier 535 integrated therewith. The barrier 535 can be cross-linked polymer. For example, the barrier can be cross-linked ethene-co-tetrafluoroethene ("ETFE"), cross-linked fluoropolymer, cross-linked fluoroelastomer, or another polymer that is cross-linked. The second insulating layer 530 can be formed by extruding a first layer of polymer about the first armor wire layer, extruding the barrier 535 about the first layer of polymer, and extruding a second layer of polymer 538 about the barrier. The layers of polymer can be virgin polymer or other polymers.

The second armor wire layer 540 is located about the second insulating layer 530, and the outer jacket 550 is located about the second armor wire layer 540. The outer jacket 550 can bond with the second insulating layer 530.

The cable 500 can be made by extruding the first insulating layer 515 over the cable core 510. The first insulating layer 515 can be heated to make it soft, and the first armor wire layer can be helically cabled about the soft first insulating layer 515, allowing the first armor wire layer 520 to at least partially embed into the first insulating layer 515.

The second insulating layer 530 can be placed about the first armor wire layer 520. For example, a first layer of polymer can be extruded about the first armor wire layer 520, the barrier 535 can be extruded about the first layer of polymer and a second layer of polymer 538 can be extruded about the barrier 535. The first layer of polymer can bond with the first insulating layer 515.

The second insulating layer 530 can be heated to soften it, and the second armor wire layer 540 can be placed about the softened second insulating layer 530; thereby, allowing the second armor wire layer 540 to at least partially embed into the second insulating layer 530. The second armor wire layer 540 can be cabled counter-helically about the second insulating layer 530. The depth that the second armor wire layer 540 can penetrate into the second insulating layer 530 is controlled by the location of the barrier 535.

The outer jacket 550 can be extruded about the second armor wire layer 540, and the outer jacket 550 can bond with the second insulating layer 530.

Figure 6A:
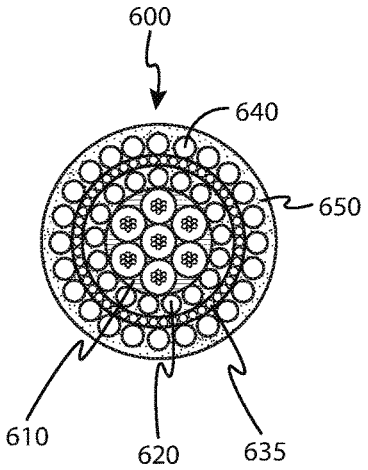
FIG. 6A depicts another embodiment of a cable.
Figure 6B:
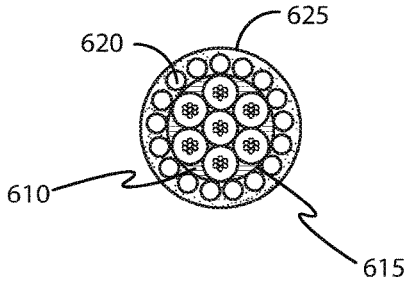
FIG. 6B depicts the cable core of the cable of FIG. 6A with a first armor wire layer located thereabout.
Figure 6C:
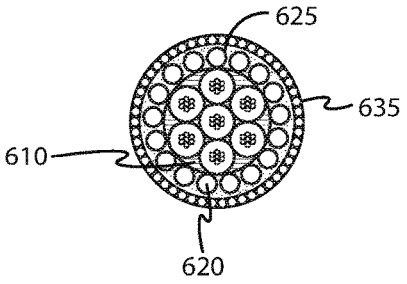
FIG. 6C depicts a second insulating layer disposed about the first armor wire layer of FIG. 6B.
Figure 6D:
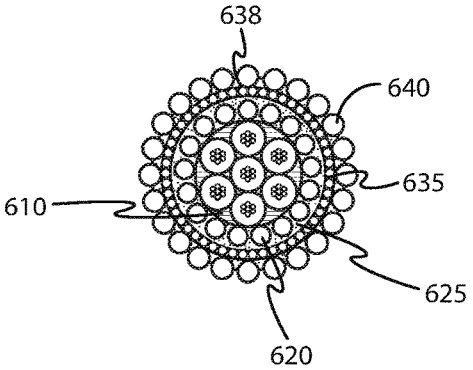
FIG. 6D depicts a second armor wire layer disposed about the second insulating layer of FIG. 6C.

FIG. 6A depicts another embodiment of a cable. FIG. 6B depicts the cable core of the cable of FIG. 6A with a first armor wire layer located thereabout. FIG. 6C depicts a second insulating layer disposed about the first armor wire layer of FIG. 6B. FIG. 6D depicts a second armor wire layer disposed about the second insulating layer of FIG. 6C.

Referring to FIGS. 6A to 6D, the cable 600 has a cable core 610, a first armor layer 620, a second armor layer 640, a barrier 635, and an outer jacket 650.

The cable core 610 has a first insulating layer 615 located thereabout. The first insulating layer 615 has the first armor wire layer 620 located thereabout. A second insulating layer 625 is located about the first armor wire layer 620.

The second insulating layer 625 has the barrier 635 integrated therewith. The barrier 635 can be helically cabled yarn in a matrix of ETFE, fluoropolymer, or another polymer.

The second armor wire layer 640 is located about the second insulating layer 625, and the outer jacket 650 is located about the second armor wire layer 640.

The cable 600 can be made by extruding the first insulating layer 615 about the cable core 610. The first insulating layer 615 can be heated until it is soft, and the first armor wire layer 620 can be placed about the first insulating layer 615. The first armor wire layer 620 can be helically cabled about the first insulating layer 615, and the first armor wire layer 620 can at least partially embed into the first insulating layer 615.

The second insulating layer 630 can be placed about the first armor wire layer 620. For example, the second insulating layer 630 can be placed about the first armor wire layer 620 by extruding a first layer of polymer about the first armor wire layer 620, extruding the barrier 635 about the first layer of polymer and extruding a second layer of polymer about the barrier 635.

The second insulating layer 630 can be heated to make it soft, and the second armor wire layer 640 can be placed about the second insulating layer 630. For example, the second armor layer 640 can be counter-helically cabled about the second insulating layer 630, and the second armor layer 640 can at least partially embed into the second insulating layer 630. The barrier 635 limits the penetration depth of the second armor wire layer 640.

The outer jacket 550 can be extruded about the second armor wire layer 540, and the outer jacket 550 can bond with the second insulating layer 630.

Figure 7:
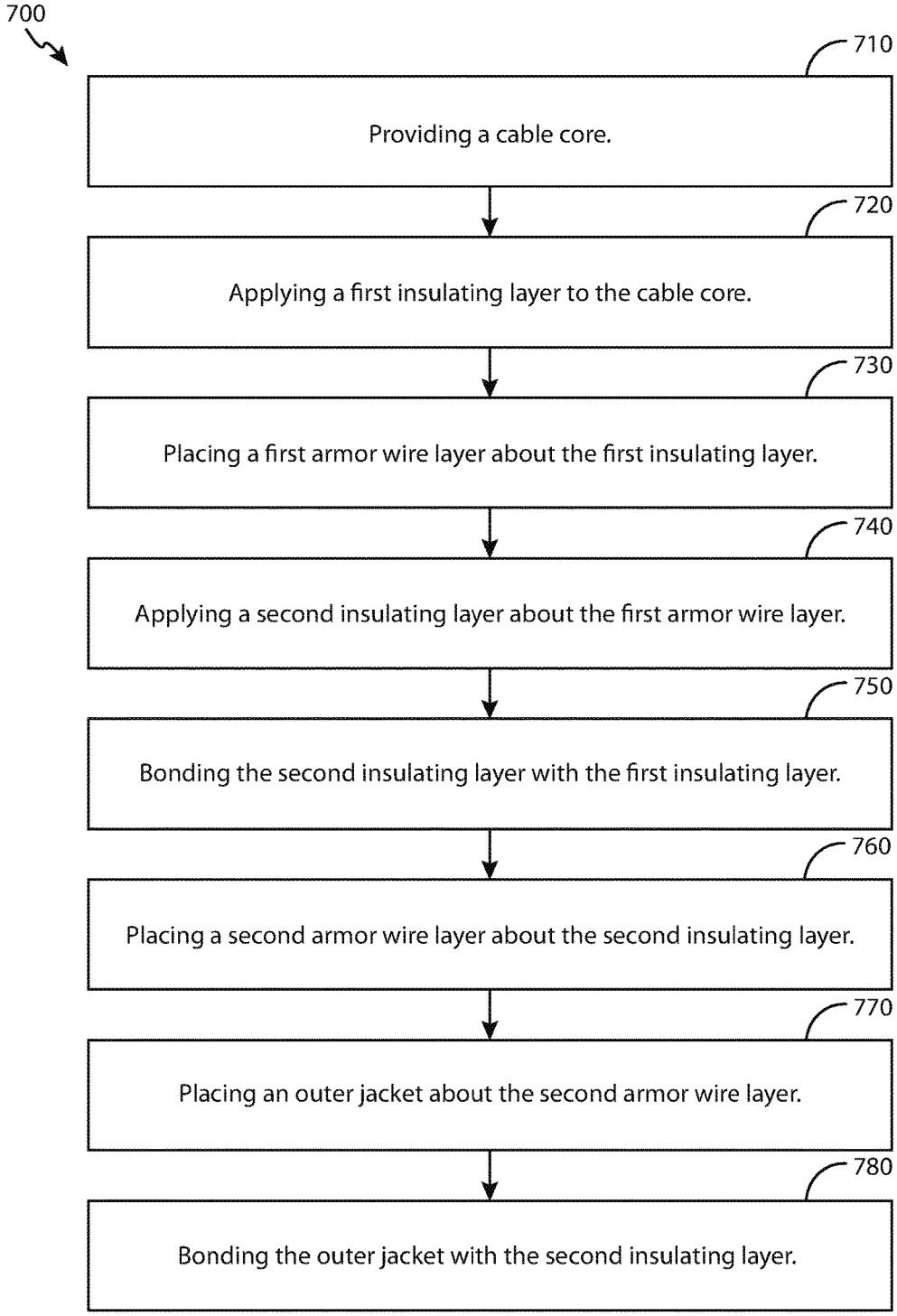
FIG. 7 depicts a flow diagram of an embodiment of a method of making a cable.

FIG. 7 depicts a flow diagram of an embodiment of a method of making a cable.

The method 700 is depicted as a series of operations or blocks.

The method includes providing a cable core (box 710). The method also includes applying a first insulating layer to the cable core (box 720). Then the method includes placing a first armor wire layer about the first insulating layer (box 730).

The method can also include applying a second insulating layer about the first armor wire layer (box 740), and bonding the second insulating layer with the first insulating layer (box 750). The method further includes placing a second armor wire layer about the second insulating layer (box 760).

The method further includes placing an outer jacket about the second armor wire layer (box 770), and bonding the outer jacket with the second insulating layer (box 780).

Although example assemblies, methods, systems have been described herein, the scope of coverage of this patent is not limited thereto. On the contrary, this patent covers every method, apparatus, and article of manufacture fairly falling within the scope of the appended claims either literally or under the doctrine of equivalents.

What is claimed is:

1. A method of making a cable, wherein the method comprises:

placing a first armor wire layer about a cable core and a first insulating layer;

placing a second insulating layer about the first armor wire layer;

shaping the second insulating layer to have a plurality of ridges or integrating a barrier into the second insulating layer;

placing a second armor wire layer about the second insulating layer, thereby, segregating the first armor wire layer from the second armor wire layer; and placing an outer jacket about the second armor wire layer.

2. The method of claim 1, further comprising:

heating the first insulating layer before the first armor wire layer is disposed thereabout, allowing the first armor wire layer to at least partially embed into the first insulating layer.

3. The method of claim 1, wherein the method further comprising:

embedding the second armor wire layer into the second insulating layer by heating an outer portion of the second insulating layer that is disposed about an inner portion of the second insulating layer.

4. The method of claim 1, wherein the barrier comprises a bondable tape, a cross-linked polymer, or a cabled yarn.

* * * * *